United States Patent [19]

Ito et al.

[11] Patent Number: 5,052,355

[45] Date of Patent: Oct. 1, 1991

[54] LUBRICATION SYSTEM FOR TWO CYCLE ENGINE

[75] Inventors: Hideaki Ito; Masanori Miyamoto, both of Iwata, Japan

[73] Assignee: Yamaha Hatsudoki Kabushiki Kaisha, Iwata, Japan

[21] Appl. No.: 613,150

[22] Filed: Nov. 15, 1990

[30] Foreign Application Priority Data

Nov. 15, 1989 [JP] Japan ..... 1-296456

[51] Int. Cl.[5] ..... F01M 1/00

[52] U.S. Cl. ..... 123/196 R; 123/73 AD; 184/6.5

[58] Field of Search ..... 123/196 R, 73 AD; 184/6.5, 6.8

[56] References Cited

U.S. PATENT DOCUMENTS

| | | | |
|---|---|---|---|
| 3,762,380 | 10/1973 | Schultz | 123/73 AD |
| 4,392,463 | 7/1983 | Yasuhara | 184/6.8 |
| 4,599,979 | 7/1986 | Breckenfeld et al. | 123/73 AD |
| 4,846,307 | 7/1989 | Kinouchi et al. | 184/6.5 |

*Primary Examiner*—Willis R. Wolfe
*Assistant Examiner*—Erick Solis
*Attorney, Agent, or Firm*—Ernest A. Beutler

[57] ABSTRACT

A lubricating system for a two cycle crankcase compression engine wherein a recirculating lubricating system is provided for lubricating at least one main bearing of the crankshaft and a second non recirculating lubricating system is provided for lubricating other components of the engine. A drain system drains lubricant accumulating within the crankcase back to the engine through its induction system upstream of a check valve contained therein.

11 Claims, 3 Drawing Sheets

LUBRICATION SYSTEM FOR TWO CYCLE ENGINE

BACKGROUND OF THE INVENTION

This invention relates to a lubricating system for a two cycle engine and more particularly to an improved system for lubricating a two cycle engine without creating excessive exhaust smoke.

The advantages of two cycle engines due to their simplicity and relatively high power output for displacement are well known. One of the advantages of a two cycle engine is that it does not normally employ a recirculating lubricating system of the type employed with four cycle engines One way in which two cycle engines have frequently been lubricated is by the mixing of lubricant with the fuel burned by the engine. However, this is not always advantageous even though it has the advantage of simplicity. The reason for this is that the amount of lubricant required may not be directly related to the amount of fuel consumed. In addition, there may be difficulties with insuring that all components of the engine receive adequate lubrication when lubricant is only mixed with the fuel.

There have, therefore, been proposed lubricant systems for two cycle engines wherein lubricant is supplied to at least some of the components of the engine directly from a lubricant tank for lubrication. With these systems, the lubricant delivered to the engine is normally drained into the crankcase and then will pass into the combustion chamber with the intake charge and be burnt and exhausted with the exhaust gases. If lubricant accumulates to an excessive level,in the crankcase, this may give rise to an objectionable condition of providing exhaust smoke. Furthermore, the emission of excess lubricant through the exhaust system can give rise to certain pollution problems Although the problem of exhaust smoke and exhaust pollution can be controlled by reducing the amount of lubricant delivered to the engine, this can provide some problems in the event that the amount of lubricant supplied is not adequate for all components.

It is, therefore, a principal object of this invention to provide an improved lubricating system for a two cycle engine wherein exhaust smoke and exhaust pollution is controlled.

It is a further object of this invention to provide an improved lubricating system for an internal combustion engine operating on the two cycle crankcase compression principle wherein adequate lubricant is supplied to all components of the engine but exhaust of lubricant in either burned or unburned form is effectively controlled.

One way in which exhaust smoke can be avoided is by providing a recirculating lubricating system for a two cycle engine. However, with such recirculating systems, it is necessary to insure that lubricant from withdrawn from the crankcase chambers and returned to the recirculating tank before any significant amount can accumulate. The reason for this is that the intake charge will flow through the crankcase and any lubricant which may have accumulated there will be swept into the combustion chamber even if a recirculating system is employed The problem is particularly acute in conjunction with the lubrication of the crankshaft and particularly its main bearing journals. This is one of the most highly stressed portions of the engine and it is essential to insure that it receives adequate lubrication.

If a recirculating system is employed, then it is necessary to draw lubricant from each of the main bearing journals and return it to the separate recirculation tank. This provides a very complicated and expensive system.

It is, therefore, a further object of this invention to provide an improved lubricating system for a two cycle engine wherein a partial recirculating system is employed for lubricating parts of the engine including crankshaft journals that are easily accessible externally of the engine.

SUMMARY OF THE INVENTION

This invention is adapted to be embodied in a lubricating system for a two cycle reciprocating engine including a crankshaft journaled for rotation in a crankcase. The crankshaft has a first journal portion journaled in an end wall of the crankcase and a second journal portion that is positioned within the crankcase and spaced from its end walls. A first lubrication system is provided for lubricating the first journal portion. This first lubricating system is a recirculating system. A second lubricating system is provided for lubricating the second journal. This second lubricating system is a non recirculating system.

DETAILED DESCRIPTION OF THE PREFERRED EMBODIMENT OF THE INVENTION

Figure 1:
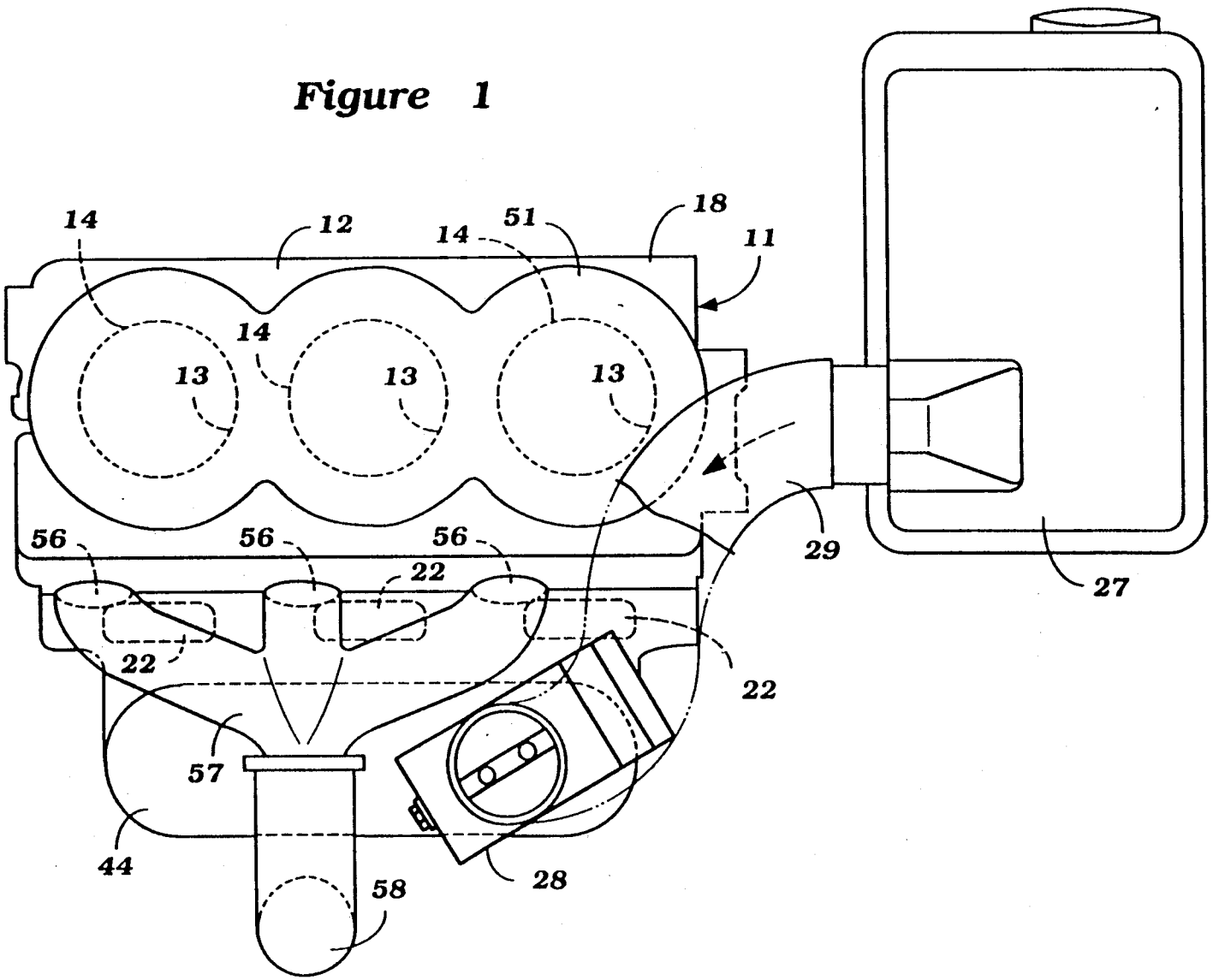
FIG. 1 is a top plan view of a two cycle crankcase compression diesel engine having a lubricating system constructed in accordance with an embodiment of the invention.

A two cycle crankcase compression diesel engine having a lubrication system constructed in accordance with an embodiment of the invention is illustrated in the drawings and is identified generally by the reference numeral 11. In the illustrated embodiment, the engine 11 is of the three cylinder in line type. It is to be understood, however, that the invention can be utilized in conjunction with engines having other cylinder numbers than three and other cylinder configurations. Also, the invention may be utilized in conjunction with engines operating on the spark ignition principle rather than on the diesel cycle The engine 11 includes a cylinder block 12 having three aligned pressed in or cast in cylinder liners that define cylinder bores 13. Pistons 14 reciprocate within the cylinder bores 13 and are connected by means of connecting rods 15 to individual throws 16 of a crankshaft, indicated generally by the reference numeral 17. The crankshaft 17 is journaled for rotation, in a manner to be described, within a crankcase chamber 18 that is affixed to the lower end of the cylinder block 12 in a suitable manner. The crankcase 18 is comprised of an upper portion 19 and a lower portion 21.

The upper crankcase portion 19 forms three intake ports 22 in which reed type check valves, indicated generally by the reference numeral 23 are positioned for precluding reverse flow. The reed type check valves 23 include a valve cage 24 having flow openings 25 formed therein. Valve plates 26 overlie these flow openings 25 and control the flow through them in a known manner.

An induction system is provided for delivering an air charge to the intake ports 22 and this includes an air cleaner 27 (FIG. 1). The air cleaner 27 draws air from the atmosphere, filters it and silences it and then delivers it to a throttle body assembly, indicated generally by the reference numeral 28, through a conduit 29.

Figure 2:
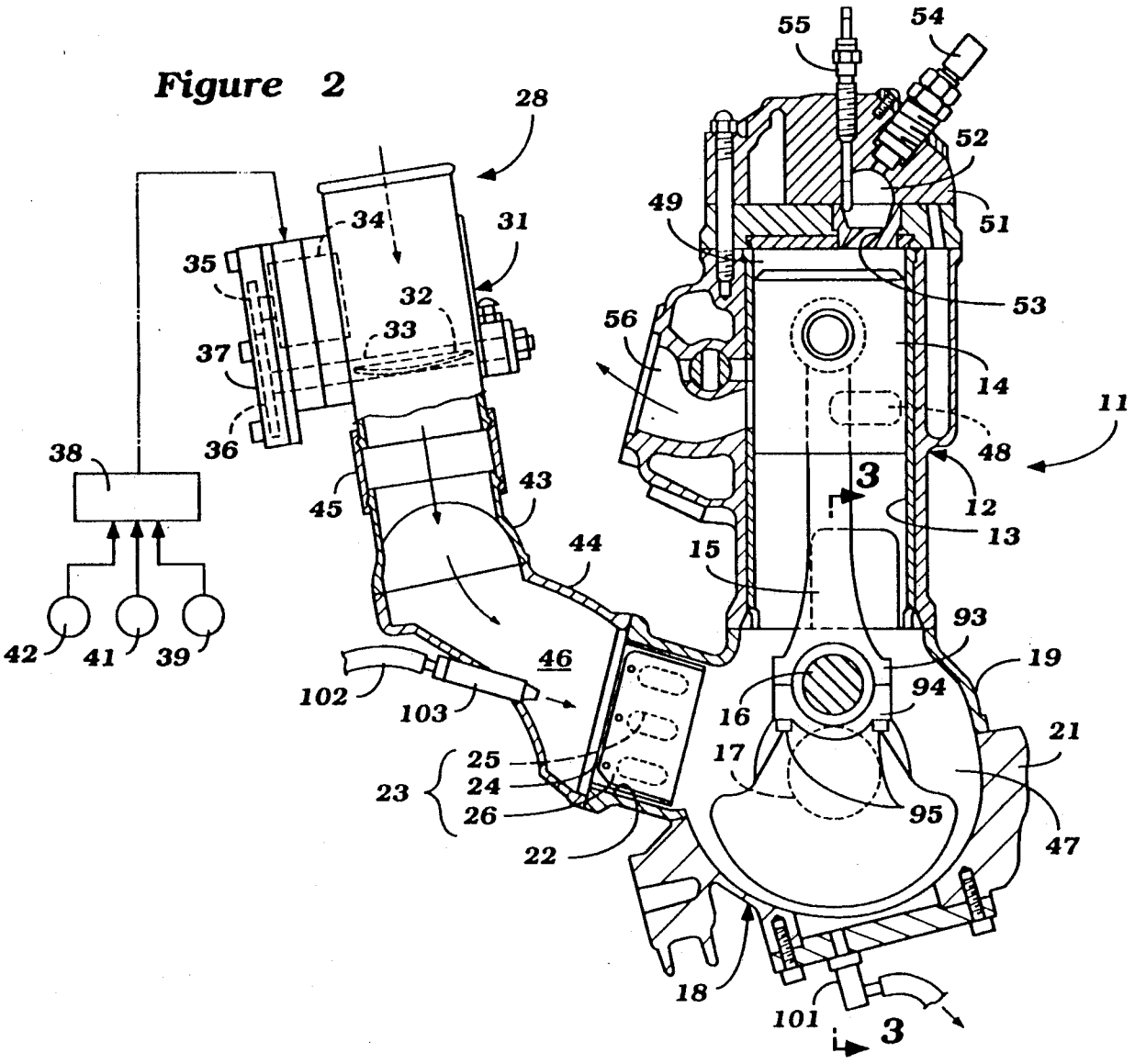
FIG. 2 is an enlarged vertical cross sectional view taken through one of the cylinders of the engine and showing certain auxiliary components in schematic form.

As may be best seen in FIG. 2, the throttle body 28 includes a main housing portion 31 in which a throttle valve 32 is journaled on a throttle valve shaft 33. The throttle valve 32 is positioned by means of a stepping motor 34 that is coupled to the throttle valve shaft 33 by a gear train comprised of gears 35 and 36 that are contained within a gear housing 37.

The position of the throttle valve 32 is controlled automatically by a controller in the form of a CPU 38 in response to certain sensed signals such as engine speed as sensed by an engine speed sensor 39, fuel injection amount, as sensed by an injection amount sensor 41 and coolant temperature as sensed by a coolant temperature sensor 42. This insures the optimum position of the throttle valve 32 for a given running condition.

The throttle body 28 and specifically its housing 31 is connected to an inlet portion 43 of an intake manifold 44 by means of a flexible connector 45. The intake manifold 44 has individual runners 46 that lead to the intake ports 22 and check valves 23.

The air charge is then delivered to individual sealed crankcase chambers 47, each associated with respective one of the cylinder bores 13 which are sealed from each other in a manner to be described. This charge is then compressed when the piston descends and is transferred through scavenge ports 48 to the area above the piston 14 and specifically a combustion chamber 49 formed by the head of the pistons 18, the cylinder bores 13 and a cylinder head assembly 51 which is affixed in a suitable manner to the cylinder block 12.

A pre combustion or torch chamber 52 is formed in the cylinder head 51 for each combustion chamber 49 and communicates therewith through a restricted throat 53. A fuel charge is injected into each pre chamber 52 from a respective injector 54 with the amount of fuel injected being sensed by the sensors 41, as previously described. The charge will then ignite in the pre chamber 52 and expand in the main chamber 49 to drive the pistons 14 downwardly.

A glow plug 55 may be provided in the cylinder head assembly 51 and extend into each pre chamber 52 for starting and warm up purposes.

The expanded and burnt charge is then discharged to the atmosphere through exhaust ports 56 formed in the cylinder block 12 and which exhaust ports communicate with an exhaust manifold 57 and exhaust pipe 58. The exhaust pipe 58 communicates with a muffler (not shown) and catalyzer, if desired, for discharge of the exhaust gases to the atmosphere.

Figure 3:
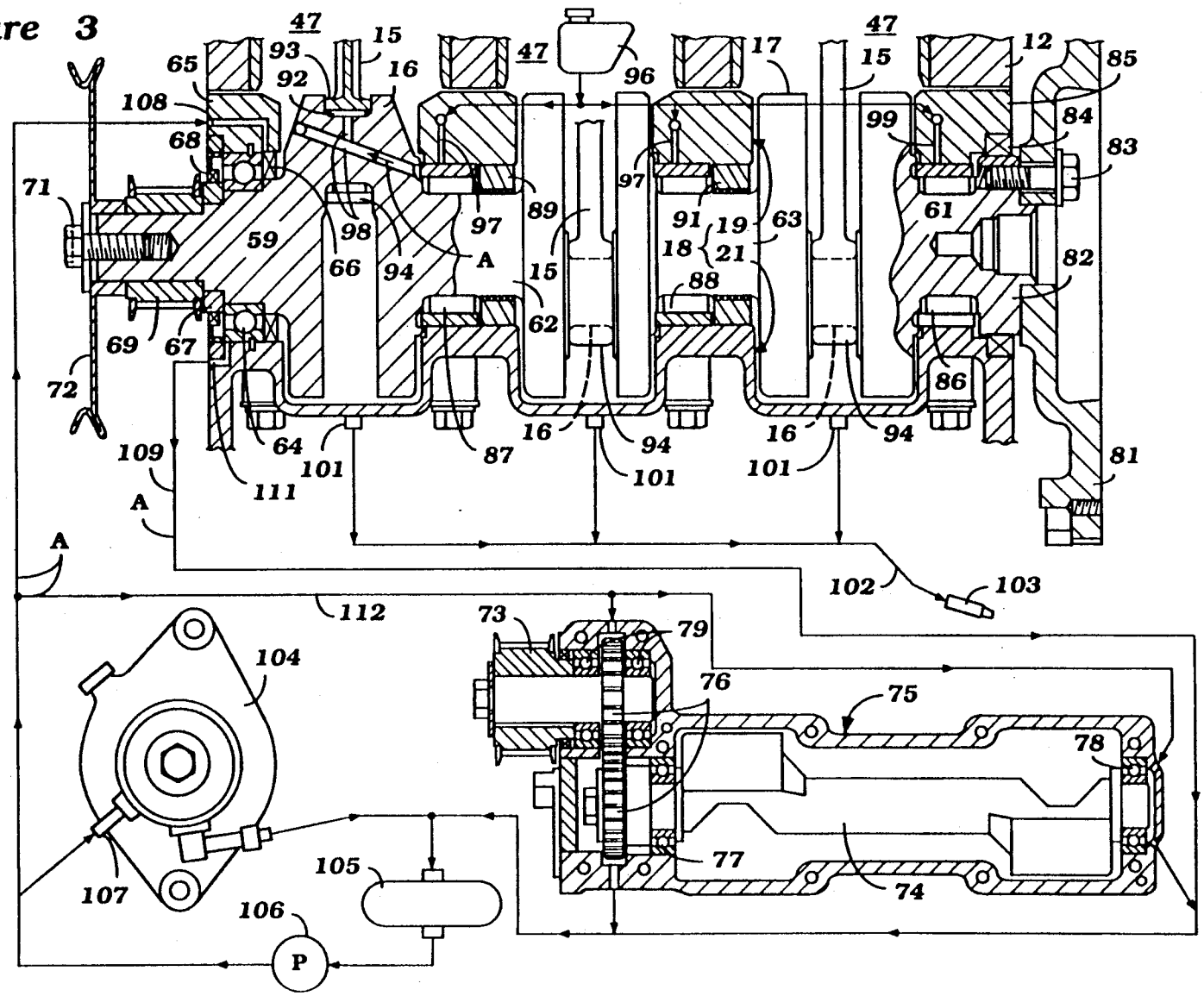
FIG. 3 is a still further enlarged cross sectional view taken along the line 3—3 of FIG. 2 and shows the lubricating systems for the engine.

Referring now in detail primarily to FIG. 3, it will be seen that the crankshaft 17 in addition to its throws 16 which receive the connecting rods 15 is formed with a front main bearing portion 59, a rear main bearing portion 61 and two intermediate main bearing portions 62 and 63. The front main bearing portion 59 is journaled by means of a ball bearing 64 that is mounted in a front wall 65 of the crankcase 18. An oil seal 66 is provided at the inner end of the wall 65 to seal the forward crankcase chamber 47 from the atmosphere and also so as to seal the ball bearing 64. A spacer 67 is positioned adjacent the outer face of the bearing 64 and is engaged by an oil seal 68 so that the bearing 64 will be contained within a sealed area.

A balancer drive pulley 69 is affixed to the front end of the crankshaft 17 by means of a nut 71 along with a drive pulley 72 for driving various engine accessories.

As may be seen in the lower portion of FIG. 3, the balancer assembly for the engine includes a driven sprocket 73 that is driven by a toothed belt from the sprocket 69 and which drives a balancer shaft 74 contained within a balancer housing 75 through a gear train 76. The balancer shaft 74 is journaled by front ball bearings 77 and rear ball bearings 78. In addition, the input shaft is also journaled by ball bearings 79.

The rear end of the crankshaft 17 has affixed to it a flywheel or clutch assembly 81 which engages a shoulder 82 formed by an enlarged end of the crankshaft 17 by means of bolts 83. An oil seal 84 is contained within a rear wall 85 of the crankcase 18 and sealingly engages this shoulder portion 82. A needle type bearing 86 having a split housing is received within the crankcase rear wall 85 for journaling the crankshaft bearing portion 61.

Similar needle type bearing assemblies 87 and 88 having split housings are provided between the crankcase members 19 and 21 for journaling the internal main bearing portions 62 and 63 of the crankshaft 17. Oil seals 89 and 91 are positioned adjacent the bearings 87 and 88 so as to seal the crankcase chambers 47 from each other as aforenoted.

The connecting rods 15 are connected to the crankshaft throws 16 also by means of needle bearing assemblies, indicated by the reference numeral 92 which are contained between the big end 93 of the connecting rods 15 and a bearing cap 94 affixed thereto in a known manner, as by connecting rod bolts 95.

A non recirculating type lubricating system is provided for lubricating the connecting rod bearings 92 and crankshaft throws 16 as well as the internal bearings 62 and 63 and needle bearings 87 and 88 for the crankshaft. This non-recirculating lubricating system includes a lubricant reservoir 96 which is positioned appropriately externally of the engine and, if a gravity flow system is provided, is at a higher elevation than the crankcase 18. A conduit is formed in the crankcase member 19 and communicates with delivery passages 97 that extend to the bearing surfaces 62 and 63 and specifically to the needle type bearings 87 and 88 associated therewith. The flow of lubricant to these passages is indicated by the arrows in FIG. 2. In addition, lubricant may flow to the connecting rod bearings 92 through passages 98 drilled in the throws 16 of the crankshaft so as to lubricate these surfaces. Only one such passage is indicated in the drawings and is identified by the reference character A.

In addition, the rear main bearing 86 is lubricated by means of a passageway 99 formed in the rear wall 85 of the crankcase 18 and specifically the member 19 thereof.

Any lubricant which remains after having lubricated the main bearings 87 and 88 and connecting rod bearings 92 will collect in individual wells at the base of each of the crankcase chambers 47 and be discharged through check valves 101 into a conduit 102. The check valves 101 are designed so as to preclude any leakage of compression pressure from the crankcase chambers 47 but to permit the flow of lubricant into the conduit 102 at such times as the crankcase chambers 47 are not pressurized. Also, these valves preclude any reverse flow into the crankcase chambers 47.

As may be best seen in FIGS. 2 and 3, the conduit 102 extends to a nozzle 103 that is positioned in a common portion of the intake manifold 44 so that is will be sprayed into the induction passages and impinge upon the check valve 23. The lubrication of the plates 26 of the check valves 23 will preclude any slapping noise when the plates 26 move to their closed position. Also, any lubricant which may pass into the crankcase chambers 47 will be vaporized and can be utilized to lubricate the upper end of the connecting rods 15 and the cylinder bore 13 as well as pistons 14.

Although a gravity flow system has been described in conjunction with the non recirculating lubricating system, a lubricant system employing a metering pump may be employed in lieu of a gravity flow system. With a gravity flow system, the amount of lubricant delivered is determined by the sizes of the conduits or by an orifice in the various lubricant conduits.

In order to assure lubrication of the front main bearing 64 and also other auxiliary components such as the balancer assembly 75 and other engine driven accessories such as a power steering pump, indicated by the reference numeral 104, there is provided a separate recirculating lubricating system. This separate recirculating lubricating system includes a lubricant storage and return tank 105 and a pressure pump 106. The pressure pump 106 delivers lubricant under pressure to a lubricant inlet 107 of the power steering pump 104 and also to a metered lubricant delivery passage 108 formed in the front end of the crankcase wall 65. This passage 108 extends to the front main bearing 64 between the seals 66 and 68. The lubricant is then returned through a return line 109 through a port 111 in the lower portion of the front wall 65 of the crankcase 18. This lubricant is then returned to the storage tank 105 for recirculation. There is also provided a separate pressure line 112 downstream in the circuit from the pump 106 which goes to the bearings 77, 78 and 79 of the balancer assembly 75 for its lubrication. This lubricant is also returned to the tank 105 through the line 112.

As a result of the aforedescribed construction, it is possible to insure good and adequate lubrication of the front main bearing for the crankshaft 17 without having excess oil accumulate in the crankcase which could find its way into the combustion chambers 49. In addition, the non recirculating lubricating system can be designed so as to meter accurate amounts of lubricant to those components contained within the crankcase and, if desired, the rear main bearing. Of course, a separate pressure line could also be provided to the rear main bearing with a return line from it like that utilized to lubricate the front main bearing. However, it is not desirable or necessary to lubricate the intermediate main bearings 87 and 88 by such a recirculating system. Therefore, it should be clear that the system disclosed provides adequate lubrication from the engine and also good control over exhaust emissions.

The foregoing description is that of a preferred embodiment of the invention and it should be obvious to those skilled in the art that various changes and modifications may be made without departing from the spirit and scope of the invention, as defined by the appended claims.

We claim:

1. A lubricating system for a two cycle reciprocating engine including a crankshaft journaled for rotation within a crankcase, said crankshaft having a first journal portion journaled by an end wall of said crankcase and a second journal portion positioned within said crankcase and spaced from the end walls thereof, a first lubricating system for lubricating said first journaled portion, said first lubricating system comprising a recirculating system, and a second lubricating system for lubricating said second journal, said second lubricating system being a non recirculating system.

2. A lubricating system as set forth in claim 1 wherein the first lubricating system further lubricates other components driven by said crankshaft.

3. A lubricating system as set forth in claim 1 wherein the first lubricating system includes a lubricant storage and return tank and a pump for circulating lubricant to the first journal portion of the crankcase.

4. A lubricating system as set forth in claim 3 wherein the first lubricating system further lubricates other components driven by said crankshaft.

5. A lubricating system as set forth in claim 1 wherein excess lubricant from the second lubricating system is delivered to the crankcase.

6. A lubricating system as set forth in claim 5 further including drain means for draining accumulated lubricant from the crankcase and returning it to the engine.

7. A lubricating system as set forth in claim 6 wherein the engine operates on a two cycle crankcase compression principle and has an induction system for delivering at least an air charge to the crankcase and reed valve means for precluding reverse flow through the induction system.

8. A lubricating system as set forth in claim 7 wherein the drains from the crankcase are returned to the induction system upstream of the reed valve means.

9. A lubricating system as set forth in claim 7 wherein the first lubricating system includes a lubricant storage and return tank and a pump for circulating lubricant to the first journal portion of the crankcase.

10. A lubricating system as set forth in claim 9 wherein the second lubricating system has a separate storage tank for lubricant.

11. A lubricating system as set forth in claim 10 wherein the first lubricating system further lubricates other components driven by said crankshaft.

* * * * *